US007182548B1

(12) United States Patent
Womack

(10) Patent No.: US 7,182,548 B1
(45) Date of Patent: Feb. 27, 2007

(54) ONE-PIECE SAFETY CLEAT

(76) Inventor: John Christopher Womack, 1413 U.S. Hwy. 82 West, Nocona, TX (US) 76255

( * ) Notice: Subject to any disclaimer, the term of this patent is extended or adjusted under 35 U.S.C. 154(b) by 0 days.

(21) Appl. No.: 11/258,306

(22) Filed: Oct. 25, 2005

(51) Int. Cl.
*E01C 11/24* (2006.01)

(52) U.S. Cl. ..... 404/21; 404/15; 404/19; 428/595

(58) Field of Classification Search ..... 404/15, 404/19, 21, 40, 71; 428/596, 687
See application file for complete search history.

(56) References Cited

U.S. PATENT DOCUMENTS

| | | | | |
|---|---|---|---|---|
| 791,017 | A | 5/1905 | Farmer | |
| 1,789,525 | A * | 1/1931 | Hoff | 404/15 |
| 2,153,347 | A * | 4/1939 | Schenck | 404/21 |
| 2,304,345 | A * | 12/1942 | Elliott | 404/15 |
| 2,486,911 | A | 11/1949 | Becker | |
| 2,635,513 | A * | 4/1953 | Batterson | 404/15 |
| 3,040,636 | A * | 6/1962 | Simm et al. | 404/15 |
| 3,181,440 | A | 5/1965 | Mullaney et al. | |
| 3,425,624 | A | 2/1969 | Jacobs | |
| 3,627,502 | A * | 12/1971 | Rees et al. | 428/600 |
| 3,648,320 | A | 3/1972 | Woolley | |
| 4,111,585 | A | 9/1978 | Mascaro | |
| 4,621,942 | A | 11/1986 | Hill | |
| 4,998,670 | A | 3/1991 | Peterson | |
| 5,217,319 | A * | 6/1993 | Klohn | 404/15 |
| D442,704 | S | 5/2001 | Lee | |
| D511,117 | S * | 11/2005 | Farrahi | D10/113 |

* cited by examiner

*Primary Examiner*—Gary S. Hartman
(74) *Attorney, Agent, or Firm*—Lynn E. Barber

(57) ABSTRACT

A one-piece safety cleat with a flat base having an upstanding rim surrounding it to form an open shallow cup-structure. The rim has at least one drainage opening. Multiple one-piece safety cleats can be attached to flooring to increase traction on the floor surface.

10 Claims, 2 Drawing Sheets

ONE-PIECE SAFETY CLEAT

BACKGROUND OF THE INVENTION

1. Field of the Invention

This invention relates to skid-resistant floor surfaces and other surfaces, for example, to floor plates provided with anti-skid tread surfaces.

2. Description of the Related Art

Slip-resistant floors or floors or other surfaces with improved traction are needed in a variety of environments, including workplaces, recreational facilities, industrial facilities, factories, ships, barges, offshore drilling rigs, rescue vehicles, military environments and vehicles, and residential dwellings. Floors made of metal plates are routinely used in industrial manufacturing plants, on drilling platforms, ladders, catwalks, ramps, and other areas where people are required to walk where water or other fluids and other materials are routinely spilled or intentionally placed on the floor surface, and/or there is a need to be able to clean the floor surface using high-powered washing equipment and the like. Particularly when such metal floors are wet, they can be dangerous to walk on because there is little or no traction under a person's feet. To increase traction and reduce accidents, most industrial metal floors are provided with raised stamped surface patterns called floor plate as is shown in FIG. 1. These types of floors can still be dangerous when covered with grease or oil or other liquids, or during and after weather conditions producing rain, snow, sleet, and ice.

There are many different methods that have been tried to increase traction and reduce accidents in a variety of situations. The patent of Dean (U.S. Pat. No. 1,176,436) provides an antislipping two-part tread structure having a case-hardened button base with a flange and drain passages extending down to the base. An anchoring stud with a flange engages the base, with a tapered lower shank and anvil head, driven through a previously formed opening in a sidewalk or the like.

The stamped tread plate of Mullaney et al. (U.S. Pat. No. 3,181,440) has an upstanding extruded flange with a gulleted edge and draining openings around the flanges. The safety tread of Farmer (U.S. Pat. No. 791,017) includes sockets with an upstanding wall around each socket, filled with plugs of anti-slipping material held in with inwardly-projecting lugs.

Traction grip plates for use under tires include those of Becker (U.S. Pat. No. 2,486,911) in which a sheet metal plate is punched to make protruberances, extending both upward and downward; Peterson (U.S. Pat. No. 4,998,670) which is a ribbed traction mat for vehicles with cup-like cleats riveted to the mat; and Jacobs (U.S. Pat. No. 3,425,624) made of flexible elongated strips having metal cleats on them.

Modules containing open cells with upwardly protruding edges but used to support weight loads and traffic in areas such as turfgrass areas include those of Mascaro (U.S. Pat. No. 4,111,585); Hill (U.S. Pat. No. 4,621,942) and Lee (U.S. Pat. No. Des. 442,704).

The prior anti-skid and traction devices either are not useful on industrial floor surface or are complicated to install or make, generally being multi-part devices, and they alter the structural integrity of the surface. Having a multi-part structure, for example when a traction device is bolted or attached to the floor with a second attachment piece, may increase the possibility of the traction device becoming unattached and creating a dangerous situation in an industrial environment.

It is therefore an object of the invention to provide a one-piece safety cleat, for use in improving traction on floor surfaces or any surface, that is simple to make and easy to install on an already installed floor or other surface and not alter structural integrity of the floor or other surfaces (for example, by requiring holes to be made in the surface). It is a further object of the invention to provide a one-piece safety cleat that is durable, can be easily attached or installed or manufactured on new floor, can be customized to fit any surface, including surfaces of any thickness, and when properly attached provides a floor surface that is slip-resistant in wet, muddy, icy or chemical or oily conditions.

Other objects and advantages will be more fully apparent from the following disclosure and appended claims.

SUMMARY OF THE INVENTION

The invention herein is a one-piece safety cleat. The base of the one-piece safety cleat is flat and has an upstanding rim surrounding it to form an open shallow cup-structure. The rim has at least one drainage opening. Multiple one-piece safety cleats can be attached to flooring or any other surface to increase traction on the surface.

Other objects and features of the invention will be more fully apparent from the following disclosure and appended claims.

DETAILED DESCRIPTION OF THE INVENTION AND PREFERRED EMBODIMENTS THEREOF

Figure 1:
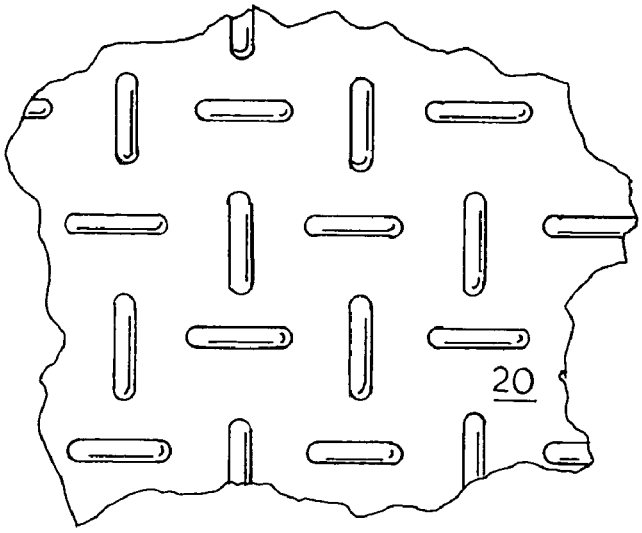
PRIOR ART FIG. 1
FIG. 1 is a plan view of a portion of a prior art floor with which the one-piece safety cleat of the invention may be used.
Figure 2:
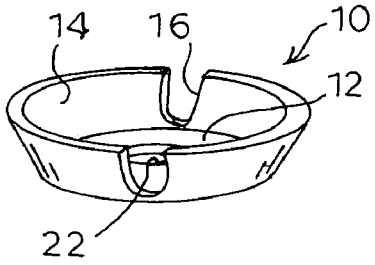
FIG. 2 is a perspective view of the one-piece safety cleat of the invention.

The present invention is a one-piece safety cleat as described in more detail below, for mounting on a substrate 20 such as a floor surface, such as the prior art floor surface shown in FIG. 1 that is a ¼ inch steel floor plate with a pattern stamped thereon or otherwise formed during manufacture.

The one-piece safety cleat is preferably made using 16 gauge 304 stainless steel; however other gauges and quality of stainless steel or other materials may be used for particular purposes. For example, the one-piece safety cleat of the invention may be made of mild steel, aluminum, brass, copper, cast steel, cast aluminum, tool grade steel, rubber, plastic, fiberglass, or composite from ¼ inch to 26 gauge thickness.

Referring now to the Figures showing the invention, the one-piece safety cleat 10 of the invention comprises a flat base 12 having an upstanding rim 14 surrounding the flat base 12 to form an open shallow cup-structure as shown in FIGS. 2–7. The slug used to form the one-piece safety cleat 10 is preferably 1 to 1 1/16 inches in diameter before the rim is formed, and most preferably is about one (1) inch in diameter. After formation of the rim 14, the flat base 12 is about ¾ inch in diameter. The rim 14 is preferably between 3/16 and ¼ inch in height, and most preferably is about ¼ inch high.

The rim 14 has at least one drainage opening 16, and preferably has two drainage openings as shown in FIGS. 2–7. Each drainage opening 16 is preferably about 5/32-inch in width, and extends from the flat base 12 up to the top of the rim 14 (a height of preferably about ⅛ inch). Using more than two drainage openings 16 on each one-piece safety cleat 10 is likely to weaken the rim 14, and therefore is not preferred.

Figure 3:
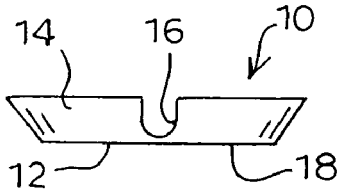
FIG. 3 is a side elevational view of the one-piece safety cleat of FIG. 2.
Figure 4:
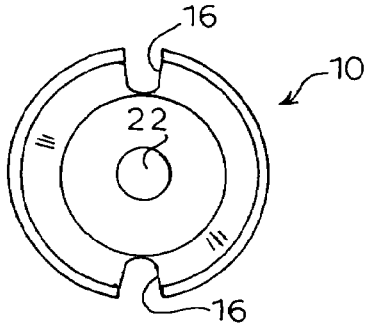
FIG. 4 is a top plan view of the one-piece safety cleat of FIG. 2.
Figure 5:
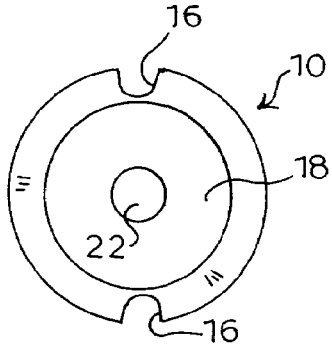
FIG. 5 is a bottom plan view of the one-piece safety cleat of FIG. 2.

The one-piece safety cleat 10 is attachable to any substrate 20 where slip resistance is needed, such as a floor surface such as a metal industrial floor or any other surface as is known in the art, preferably by welding the flat base 12 to the substrate 20 to provide increased traction. If the substrate is not metal, the one-piece safety cleat can be attached by means of glue, epoxy, screw, rivet or nail, or other attachment means known in the art for attaching to a non-metal surface, and if possible, the attachment to the non-metal surface is without drilling or at least is done without altering the structural integrity of the substrate. Because the bottom 18 of the flat base 12 of the one-piece safety cleat 10 is flat, as shown in FIG. 3, it provides a 360-degree contact with the substrate 20 on which it is mounted, and with the bottom surface of a shoe sole or other object placed on the top of the one-piece safety cleat.

The flat base 12 of the one-piece safety cleat 10 preferably has a central hole 22 for welding the flat base 12 to a substrate 20, preferably a hole having a 5/16 inch diameter; however, other sizes and shapes of the central hole 22 are possible, and may be useful in one-piece safety cleats made in different sizes than the preferred size set forth herein.

Preferably, the preferred one-piece safety cleat 10 of the invention herein is made by taking a flat slug of 16 gauge stainless steel, 1 inch in diameter. Such a slug may be made by using a punch and die on a hydraulic punch machine that punches a 1-inch diameter slug. Drain hole(s), each preferably in a half-moon shape, are made on the sides of the slug using a punch or drill, preferably at the time the slug itself is punched from the stainless steel. The slug is then formed into a cup shape having a flat base, using a forming die as known in the art placed on the hydraulic punch machine. When the punch is engaged, a 5/16-inch hole is made in the center of the slug by means known in the art. The one-piece safety cleat of the invention may also be produced in a manufacturing environment, using more automated technologies known in the art.

Figure 6:
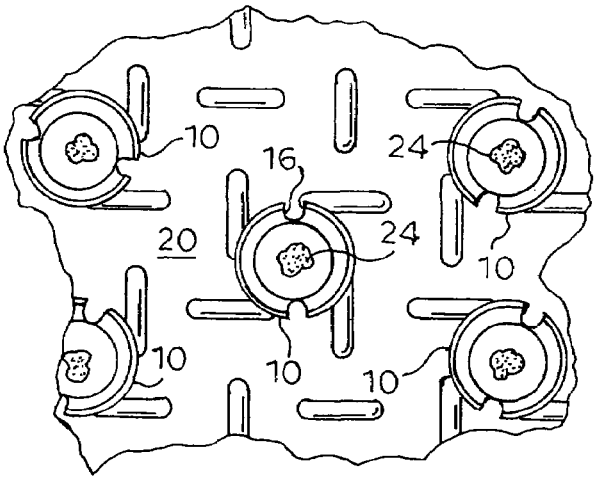
FIG. 6 is a plan view of a portion of a prior art floor on which multiple one-piece safety cleats of the invention have been attached.

Preferably multiple one-piece safety cleats 10 are mounted on a substrate 20 such as a floor surface in a regularly repeating pattern, such as is shown in FIG. 6, sufficiently closely spaced so that they provide the desired traction. Preferably, the cleats are sized so that when placed on the floor surface they fit snugly between the raised pattern on the floor as shown in FIG. 6. This aids in the prevention of something getting under the cleat and prying it loose. Also, the raised pattern on the prior floor plate protects the cleat from being removed. Typically, if the one-piece safety cleats 10 are 2–3 inches apart, sufficient traction is provided for ordinary uses; however, the one-piece safety cleats may be more closely spaced for particular purposes. Spreading the one-piece safety cleats more sparsely may reduce the effectiveness of the one-piece safety cleats by leaving too much flat surface between them The one-piece safety cleat of the invention can be customized and varied to fit particular surfaces or uses without departing from the scope of the invention. For example, the one-piece safety cleat may be made to be round (preferred), square, triangular, rectangular or oval. The one-piece safety cleat may be larger, with a higher rim if desired, to change how aggressively the one-piece safety cleat provides traction to the surface on which it is mounted. The one-piece safety cleats of the invention may also be mounted in any pattern that provides the desired traction on the chosen surface. Thus, on oddly shaped surfaces such as ladder rungs or truck beds, it may be desirable to change the pattern for the particular purpose. And, on surfaces made of different materials or in other circumstances known to those in the art, it may be desirable to make the one-piece safety cleat of different materials, for example, of rubber or plastic for use on a boat deck.

The one-piece safety cleat of the invention is simple to make and easy to install on an already installed floor, or on flooring prior to installation of the floor. It is durable, can be easily attached or installed, and can be customized to fit any surface. Floors on which the invention herein is installed have a floor surface that is slip-resistant in wet, muddy, icy or chemical or oily conditions. Installation of the one-piece safety cleat of the invention does not interfere with the structural integrity of the flooring surface, does not require there to be holes in the flooring, and can be done on existing surfaces instead of replacing the entire surface or any designated plate.

Figure 7:
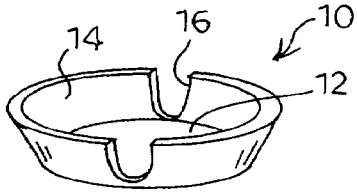
FIG. 7 is a perspective view of an alternative embodiment of the one-piece safety cleat of the invention that has no central hole.

An alternative embodiment of the one-piece safety cleat of the invention may be made without a central hole (FIG. 7). In this embodiment, the one-piece safety cleat of the invention may be attached to a surface with epoxy glue; however, this requires time for drying of the epoxy or other adhesive, and is generally not preferred in environments where it is desired to have the surface ready for use immediately upon installation of the safety cleats, such as drilling rigs or other places where operation is continuous.

In addition to being useful on previously installed or formed surfaces, the one-piece safety cleat of the invention may be manufactured on new steel surfaces and marketed this way.

While the invention has been described with reference to specific embodiments, it will be appreciated that numerous variations, modifications, and embodiments are possible, and accordingly, all such variations, modifications, and embodiments are to be regarded as being within the spirit and scope of the invention.

What is claimed is:

1. A one-piece safety cleat, comprising a flat base having an upstanding rim surrounding the flat base to form an open shallow cup-structure, wherein the rim has at least one drainage opening, and wherein the one-piece safety cleat is attachable to a floor surface by welding the flat base to the floor surface to provide increased traction on the floor surface.

2. The one-piece safety cleat of claim 1, wherein the flat base has a central hole for welding the flat base to the floor surface.

3. The one-piece safety cleat of claim 1, wherein there are two drainage openings.

4. The one-piece safety cleat of claim 1, wherein the rim is ¼ inch in height and the flat base has a diameter of ¾ inch.

5. The one-piece safety cleat of claim 4, wherein the drainage opening is ⅛ inch high and 5⁄32 inch wide.

6. A skid-resistant surface, comprising a plurality of one-piece safety cleats according to claim 1 welded to a substrate.

7. The skid-resistant surface of claim 6, wherein each one-piece safety cleat has two drainage openings.

8. The skid-resistant surface of claim 7, wherein the one-piece safety cleats are spaced apart on the substrate to form a regularly-repeating pattern.

9. The skid-resistant surface of claim 8, wherein the one-piece safety cleats are between two and three inches apart.

10. The skid-resistant surface of claim 6, wherein the substrate is selected from the group consisting of floors, vehicles, equipment, aquatic areas, buildings, and decks.

* * * * *